US010413474B2

(12) United States Patent
Dills

(10) Patent No.: US 10,413,474 B2
(45) **Date of Patent: *Sep. 17, 2019**

(54) MASSAGE DEVICE

(71) Applicant: AMOR Gummiwaren GmbH, Arnstadt (DE)

(72) Inventor: Michael Dills, Arnstadt (DE)

(73) Assignee: AMOR Gummiwaren GmbH, Arnstadt (DE)

( * ) Notice: Subject to any disclaimer, the term of this patent is extended or adjusted under 35 U.S.C. 154(b) by 717 days.

This patent is subject to a terminal disclaimer.

(21) Appl. No.: 14/990,850

(22) Filed: Jan. 8, 2016

(65) Prior Publication Data

US 2016/0199250 A1 Jul. 14, 2016

(30) Foreign Application Priority Data

Jan. 9, 2015 (EP) ..... 15150679

(51) Int. Cl.
*A61H 23/02* (2006.01)
*A61H 19/00* (2006.01)
(Continued)

(52) U.S. Cl.
CPC ..... *A61H 19/40* (2013.01); *A61H 23/0263* (2013.01); *H01Q 1/38* (2013.01);
(Continued)

(58) Field of Classification Search
CPC ..... A61H 19/40; A61H 23/0263; A61H 2201/5097; A61H 2201/5015;
(Continued)

(56) References Cited

U.S. PATENT DOCUMENTS

2003/0083590 A1* 5/2003 Hochman ..... A61B 5/0002 600/549
2008/0106471 A1* 5/2008 Yeh ..... H01Q 1/243 343/700 MS
(Continued)

FOREIGN PATENT DOCUMENTS

CN 101378718 A 3/2009
CN 203932525 11/2014
(Continued)

OTHER PUBLICATIONS

English Translation for WO 02/38100 A2.*
EP 15 15 0679 Search Report dated Jun. 17, 2015.

*Primary Examiner* — Quang D Thanh
(74) *Attorney, Agent, or Firm* — Jansson Munger McKinley & Kirby Ltd.

(57) ABSTRACT

According to the invention, a massage device for the massage of body parts is provided which includes a massage portion having, within a housing, a vibration-producing device, an energy storage unit, a control unit, and a wireless communications device; a cable, connected at one end to the massage portion; and a plug, arranged at the other end of the cable and adapted to establishing a connection with a charging device. The plug is flat and includes a printed circuit board having two USB-compatible charging electrodes and an antenna configured as a PCB or chip antenna for sending radio signals from and receiving radio signals in the wireless data communications device.

12 Claims, 4 Drawing Sheets

(51) Int. Cl.
*H01Q 1/38* (2006.01)
*H01Q 1/46* (2006.01)

(52) U.S. Cl.
CPC ..... *H01Q 1/46* (2013.01); *A61H 2201/5015* (2013.01); *A61H 2201/5097* (2013.01)

(58) Field of Classification Search
CPC .... A61H 2201/0107; A61H 2201/1685; A61H 19/44; A61H 19/32; H01Q 1/46; H01Q 1/38; H01Q 9/42; H01R 12/714; H01R 13/52; H01R 13/70; H01R 13/6658; H01R 2201/12; H01R 24/62
See application file for complete search history.

(56) References Cited

U.S. PATENT DOCUMENTS

| | | | | |
|---|---|---|---|---|
| 2009/0111533 | A1 | 4/2009 | Johansson | |
| 2009/0140931 | A1* | 6/2009 | Cho | H01Q 1/243 343/700 MS |
| 2010/0164835 | A1 | 7/2010 | Tai | |
| 2011/0133910 | A1 | 6/2011 | Alarcon | |
| 2011/0291910 | A1* | 12/2011 | Tsai | H01Q 1/2283 343/848 |
| 2014/0194166 | A1 | 7/2014 | Hifun | |
| 2017/0229776 | A1* | 8/2017 | Wang | H01Q 5/357 |
| 2018/0085285 | A1* | 3/2018 | Dills | A61H 19/44 |

FOREIGN PATENT DOCUMENTS

| | | |
|---|---|---|
| DE | 202013105192 | 12/2013 |
| WO | 02/38100 | 5/2002 |
| WO | 2007089638 A2 | 8/2007 |

* cited by examiner

MASSAGE DEVICE

CROSS-REFERENCE TO RELATED APPLICATION

This application claims priority based on European Patent Application No. EP 15 150 679.7, filed Jan. 9, 2015, the contents of which are incorporated by reference in its entirety.

FIELD

The invention pertains to a massage device for the massage of body parts, especially the genitals.

BACKGROUND

Massage devices of the type indicated above are also known by the name "love balls". They are used not only as an erotic toy, however, but also as an intravaginal insert for the therapeutic treatment of the pelvic floor musculature as described in, for example, EP 0 955 024 A2.

WO 02/38100 A2 describes a massage device of the known kind. One of the disadvantages of the known massage device, however, is that the bushing or connector at the free end of the retrieval cord is not configured to be liquid-tight, which means that liquid can penetrate through the opening of the bushing; this can lead to corrosion and thus to the malfunction of the device. Because of the selected dimensions of the charging cable, furthermore, the configuration of the charging cable as an antenna is limited to certain radio frequencies and to certain antenna types. In particular, it not possible with this cable to use any of the current standards of mobile data communications such as Bluetooth®, IEEE 802.11 (WLAN/WIFI), GSM, UMTS, etc., for wireless data transmission between a remote operating device such as a smartphone and the massage device.

SUMMARY

It is therefore the object of the present invention to overcome at least partially the disadvantages cited above and to provide an improved massage device which can be operated reliably, which has an easy-to-charge energy storage unit, and which can make use of current wireless data transmission technologies.

This object is achieved by the subject matter having the features of claim 1.

According to the invention, a massage device for the massage of body parts is provided comprising: a massage portion comprising in a housing a vibration-producing device, an energy storage unit, a control unit, and a wireless data communications device; a cable, which is connected at one end to the massage portion; and a plug, which is arranged at the other end of the cable and is adapted to establishing a connection with the charging device, wherein the plug is flat and comprises a printed circuit board (PCB) having two USB-compatible charging electrodes and an antenna configured as a PCT antenna or a chip antenna for sending and receiving radio signals from the wireless data communications device. Because the antenna is arranged in the plug, the data transfer between the wireless data communications device within the massage portion and a remote operating device such as a smart phone can be significantly improved. This technical solution achieves its goal without additional structural components, which results in a compact and low-cost device.

Using the USB technology means that a very widely adopted method can be used to charge the energy storage unit and also to transmit data. The flat plug comprises a configuration similar to that of a USB-A plug, which can be introduced into a corresponding USB port in the same way that a USB stick can be inserted. Connector ports of this type are present on many different devices such as PCs, laptops, notebooks, tablet computers, power grid devices, etc., and, according to the USB standard, they provide a sufficient amount of charging current (up to 500 mA at 5 V according to USB 2.0).

According to the invention, the charging electrodes and the antenna are arranged on a printed circuit board (PCB). The antenna is configured as a printed circuit board or PCB antenna, also called a "printed antenna", which can have any suitable shape and which can be applied at low cost as a metal layer, particularly made from copper, to a conventional printed circuit board. As a result, a compact component can be obtained, which saves space and lowers costs. It is advantageous for the charging electrodes to be arranged on one side of the circuit board and for the antenna to be arranged on the other side. Alternatively, the charging electrodes and the antenna can be arranged on the same side of the circuit board. This results in a plug element with an even simpler structure. It is also possible for the charging electrodes to be arranged on both sides of the circuit board, so that the plug becomes user-friendly in the sense that it can be inserted in any orientation (in either of its two orientations) into a USB port or appropriate other charging port. For this purpose, a logic circuit which recognizes the plus pole and the minus pole is required.

It is also advantageous for the antenna to be configured for the transmission and reception of Bluetooth® radio signals (according to IEEE 802.15.1), NFC (Near Field Communication) signals, WLAN/WIFI signals (wireless local area networks according to IEEE 802.11), GSM signals (Global System for Mobile Communications), UMTS (Universal Mobile Telecommunications System), LTE (Long-Term Evolution) or signals according to another mobile data transmission standard. The above-used acronyms are well known in the art.

The cable and the plug are advantageously produced in such a way that they are liquid-tight. Thus not only the massage portion, which is introduced into a body opening, but also the retrieval cord, i.e., the cable and the plug, meet the hygiene standards applicable to devices of this type, such as IP67 (DIN EN 60528). The cable and the plug can therefore be cleaned by simple measures and due to the flat structure present no openings into which liquid might intrude and thus, impair the function of the massage device.

It is preferable for the cable to comprise two strands. In particular, it is advantageous for at least one cable strand to be configured as a coaxial cable. This guarantees that the high-frequency antenna signal is exposed to the fewest possible interference signals and can be transmitted with sufficient shielding to the wireless data communications device in the interior of the housing of the massage portion. The effect of the flow of current associated with the USB charging-voltage source (DC voltage) is thus minimized.

It is also advantageous for the plug to comprise two recesses, each of which accepts one end of a strand. As a result, the overall structure of the plug can be kept flat. The ends of the strands can be easily connected to the charging electrodes and to the terminals of the antenna by soldering or by some other suitable connecting device.

The plug preferably comprises a gripping area on its surface. The gripping area is formed near the end of the plug at which the cable or strand ends are connected to the plug. This makes it possible to insert the plug into a charging port and to remove it again easily. The gripping area can be formed by grooves or by a convexity on the surface of the plug. Other useful embodiments which do not affect the function of the plug or antenna are also possible.

It is especially preferable for a biocompatible plastic sheath to cover at least part of the plug and/or the cable. As a result, the components such as the printed circuit board, the antenna, and the connection points of the cable strands are protected from corrosion, for example. It is especially preferable for the biocompatible plastic sheath to be formed by an injection-molding process. As a result, an integral plug is obtained, which offers a surface with the least possible vulnerability to damage or mishandling. The material of the plastic sheath is preferably a thermoplastic material such as acrylonitrile-butadiene-styrene copolymer (ABS) or a comparable plastic with similar properties. These thermoplastic materials are insensitive to standard commercial lubricants and cleaning agents and are also neutral with respect to taste and smell.

The material of the massage device is preferably UV-proof, odor-neutral, and taste-neutral, wherein different colors are also possible.

The charging contacts of the plug are advantageously coated with a metal or metal alloy in the form of, for example, gold or gold alloy plating or in the form of a surface enhancement with some other metal or metal alloy.

BRIEF DESCRIPTION OF THE DRAWINGS

The invention is described below in detail with reference to the embodiments shown in the drawings.

DETAILED DESCRIPTION

Figure 1:
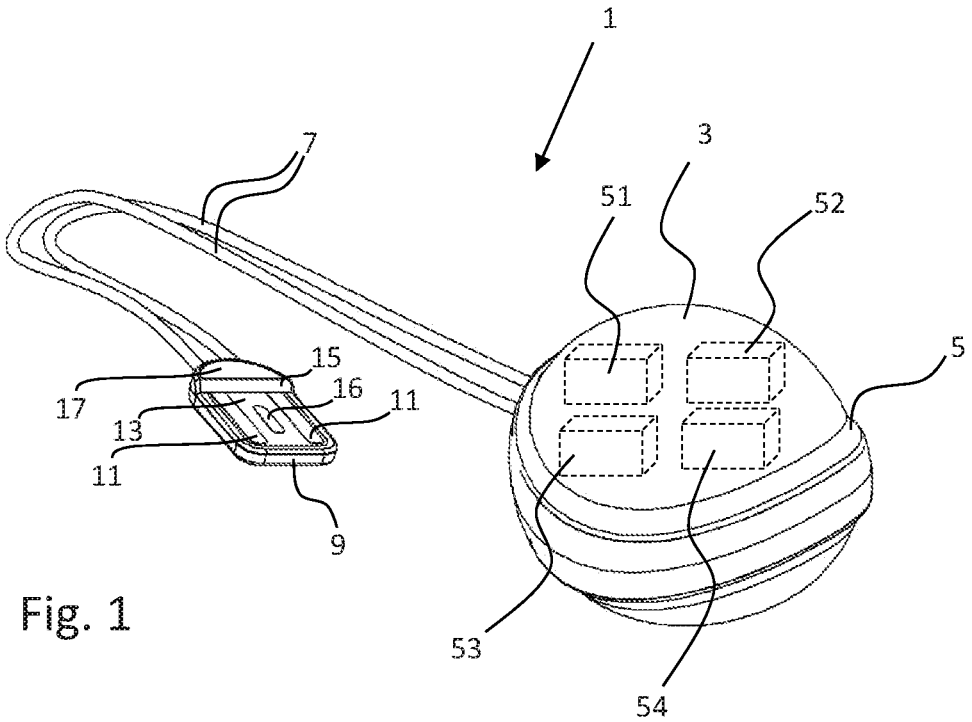
FIG. 1 shows a perspective view of a first preferred embodiment of the massage device according to the invention.

FIG. 1 shows a perspective view of a first preferred embodiment of the massage device according to the invention. The massage device 1 comprises an essentially spherical massage portion 3, which comprises the following components in a housing 5: a vibration-producing device 51, an energy storage unit 52, a control unit 53, and a wireless data communications device 54. These components, which are familiar to the person skilled in the art, are functionally and/or electrically connected to each other as appropriate in the interior of the housing 5, the principles of which are also familiar to the person skilled in the art. During operation, the energy storage unit-powered vibration-producing device 51 such as, for example, an electric motor with a weight mounted eccentrically on a shaft, causes the massage portion 3 to oscillate and vibrate. The control unit 53 inside the housing 5 receives its control commands by way of a wireless data communications device 54, which is also powered by the energy storage unit 52, and which is supplied with radio signals appropriate for control purposes from a remote operating device such as a smart phone, a PC, or a similar mobile operating platform. The control unit 53 can have a data storage device for storing programs, as a result of which it is possible to program the massage device with internally or externally specified vibration sequences. Direct control via the remote operating device is also possible.

In order to supply the components inside the massage portion 3 with current or with an antenna signal and in order to transmit a signal to the outside, the massage portion 3 is connected by a cable 7 to a plug 9; in the embodiment shown here, the cable has two strands or lines. The plug 9 is configured as a flat PCB connector and comprises on its upper surface two charging electrodes 11, arranged parallel to each other in the longitudinal direction, which are configured to be compatible with a USB-A connection. Except for the freely exposed charging electrodes 11, the plug 9 is covered by an injection-molded sheath 15, which is made of a thermoplastic material such as acrylonitrile-butadiene-styrene (ABS). On the side facing the cable 7, the sheath 15 comprises a gripping area 17 on its upper surface 13; in the embodiment shown here, the gripping area is configured as a convexity. The gripping area 17 serves to make it easier to handle the plug 9 when it is being inserted into, or removed from, a corresponding USB port. Approximately in the middle of the upper surface 13 of the plug 9, an elongated recess 16 is visible; it is present because, in the present embodiment, the plug 9 is manufactured by injection-molding, during which the component must be held properly by a tool. The elongated recess 16 is of no importance to the vibratory function, to the charging, or to the control of the massage device; it plays a role only in the production process.

Figure 2:
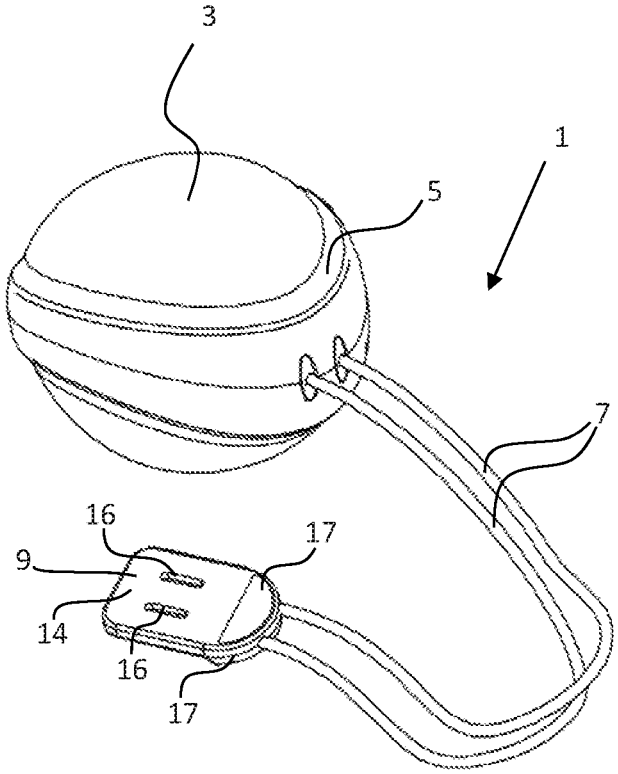
FIG. 2 shows another perspective view of the first preferred embodiment.

FIG. 2 shows a perspective view of the first preferred embodiment of the massage device according to the invention, wherein the outlets in the housing 5 of the massage portion 3 through which the cable 7 exits and the lower surface of the plug 9 can be seen. It should be pointed out here that the two strands of the cable 7 are given dimensions sufficient to allow them to be used as a retrieval cord. That is, it is possible to pull on them, possibly with the help of the plug 9, and thus to pull the massage portion 3 out of a body opening. On the lower surface 14 of the plug 9, two parallel, elongated recesses 16 are arranged, which, as on the upper surface 13, merely represent holding points used during the injection-molding step in which the internal elements of the plug 9 are coated. Another gripping area 17 is formed on the lower surface 14 of the plug 9 in the area next to the cable; in the embodiment shown here, this gripping area is formed as an elevation or as an bulge, the thickness of which increases toward the front edge of the plug 9.

Figure 3:
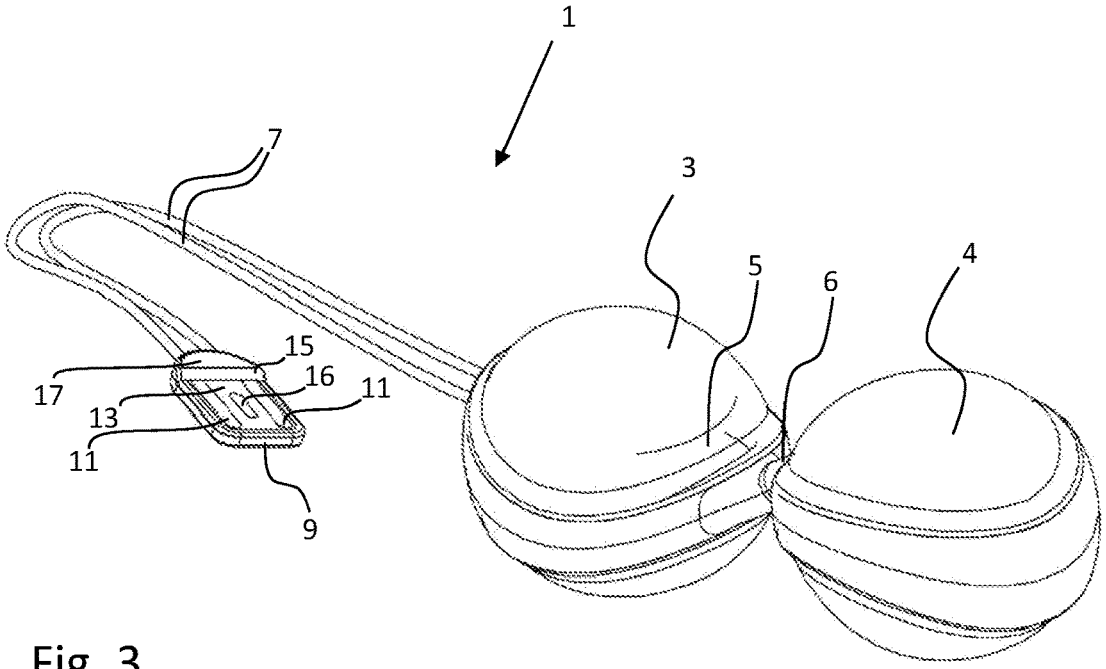
FIG. 3 shows a perspective view of a second preferred embodiment of the massage device according to the invention.
Figure 4:
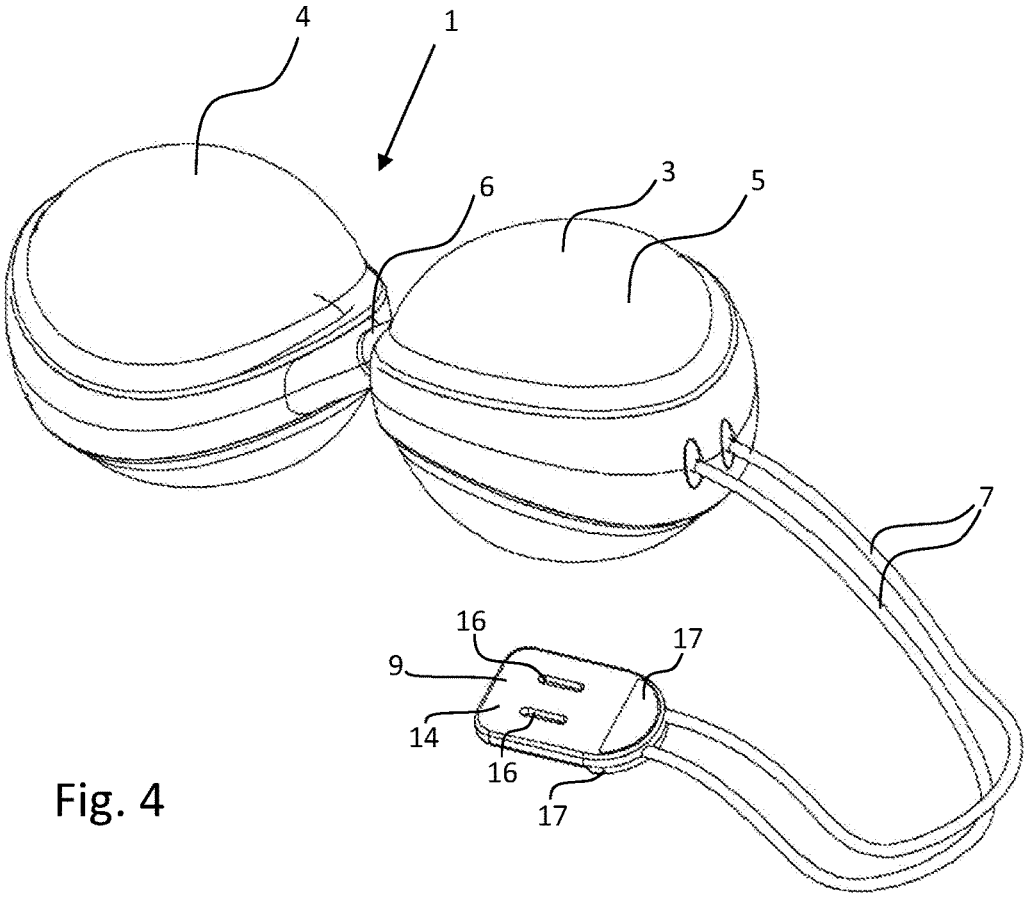
FIG. 4 shows another perspective view of the second preferred embodiment.

FIG. 3 shows a perspective view of a second preferred embodiment of the massage device according to the present invention. Because the second embodiment is similar to the first embodiment, only the differences between the two embodiments will be discussed hereinafter. The massage portion 3 of the second embodiment comprises, on the side opposite the point where the cable 7 is connected, a second massage element 4, joined to the housing 5 by a connecting element 6; this second element is essentially spherical. The outer dimensions and the shape of the second massage element 4 and of the housing 5 are essentially identical. In the interior of the second massage element 4, however, a cavity is provided, in which the freely movable ball is arranged, which has a weight sufficient to generate mechanical pulses when the second massage part 4 is moved. The structure of the second massage element 4 is essentially the same as that of a conventional mechanical love ball, in which the movement of the ball generates mechanical pulses in the interior of the ball, which pulses are then perceptible on the ball surface. The housing 5 is fixedly connected to the second massage element 4 by the connecting element 6. This connection can be configured to be detachable, so that the second massage element 4 can be removed. All of the other elements shown in FIG. 3 are identical to those of FIG. 1. The same is also true for the elements of FIG. 4, which are the same as those of FIG. 2 except for the second massage element 4.

Figure 5:
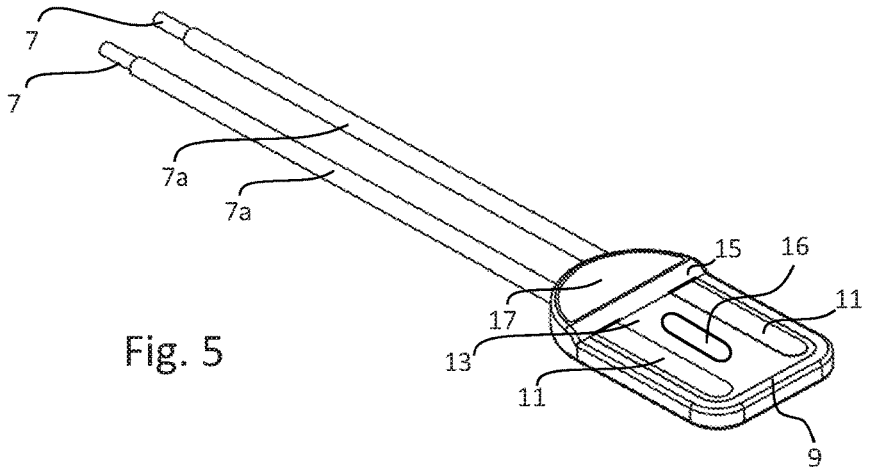
FIG. 5 shows a perspective view of a plug element with an attached cable of the preferred embodiment of the massage device according to the invention.

FIG. 5 shows a detail of the elements of FIG. 1, wherein only the plug 9 and the cable or cables 7 are visible. Reference can therefore be made to the description of FIG. 1 given above. It is indicated in FIG. 5 that cables 7 may be covered by a biocompatible plastic sheath 7*a*.

Figure 6:
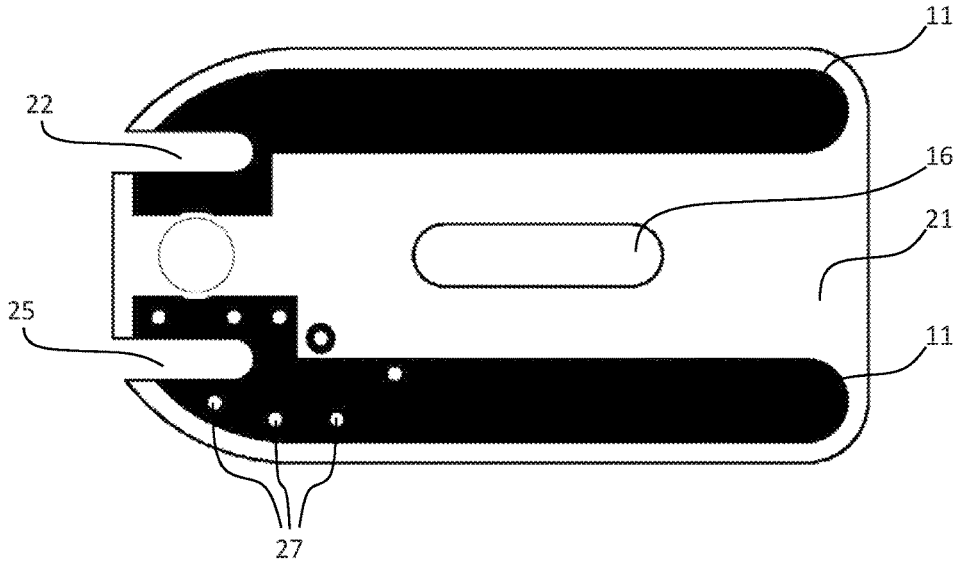
FIG. 6 shows a plan view of the upper surface of a printed circuit board of the plug element of a preferred embodiment of the massage device according to the invention.
Figure 7:
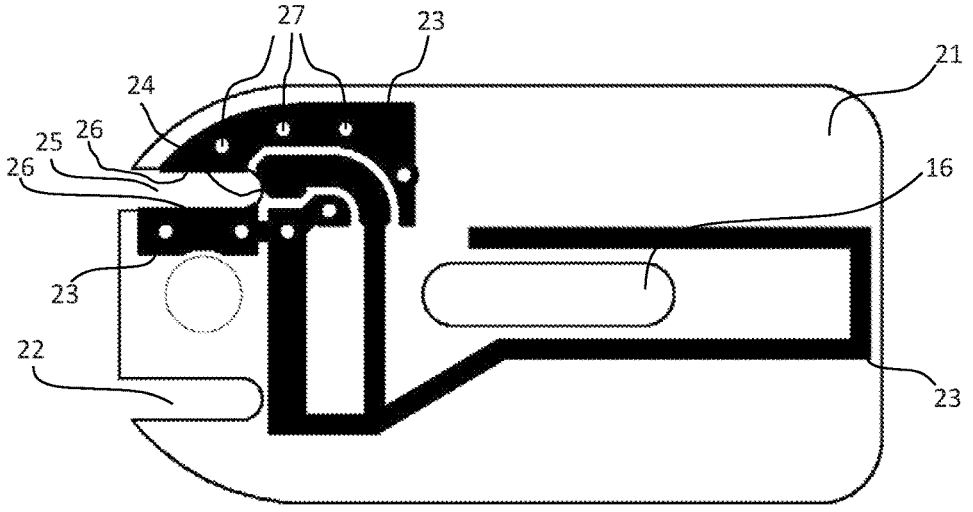
FIG. 7 shows a plan view of the lower surface of the printed circuit board of the plug element of the preferred embodiment of the massage device according to the invention.

FIGS. 6 and 7 show plan views of the upper and lower surfaces of the printed circuit board (PCB) 21, respectively, with the two charging electrodes 11 and the antenna 23 which form the core of the plug 9. It should be noted that, after the material for the charging electrodes 11 and the antenna 23 has been applied and after the cable strands have been connected, the PCB 21 is then covered with a plastic sheath by an injection-molding process. It is only after this step that the plug 9 is complete.

FIG. 6 shows the upper surface of the PCB, on which two charging electrodes 11 are applied, parallel to each other in the longitudinal direction. The dimensions, i.e., in particular the distance between the two charging electrodes 11 and their length, are calculated in such a way that the plug 9 can be inserted into an appropriate USB port for charging. The charging electrodes 11 make contact with the connecting ends of the two cable strands in the first and second recesses 22, 25. In the preferred embodiment, the cable 7 is configured with two strands, wherein the first strand is a simple cable with stranded wire, the end of which is connected to the positive charging electrode (the upper charging electrode 11 in FIG. 6). The second strand of the cable 7 is configured as a coaxial cable, wherein the outer conductor is connected to the charging electrode 11 in the second recess 25, this electrode being defined as the ground pole. The white dots in the part of the ground electrode on the left characterize the vertical interconnect accesses leading to the lower surface of the circuit board, as will be described again with reference to FIG. 7.

FIG. 7 shows the lower surface of the printed circuit board 21, to which the antenna 23 has been applied as a conductive layer by known technology. A PCB antenna of this type or a chip antenna is characterized by a compact form. In the invention, it is advantageous for the PCB antenna in the plug 9 to be remote from the components and the printed circuit of the wireless data communications device in the massage portion 3, because in this way secondary excitations and thus interference caused by the high-frequency properties of the PCB antenna can be significantly reduced.

The shape of the printed antenna paths or strips or chip is optimized for good broadcast characteristics, high efficiency for reception and transmission, and adequate bandwidth. The antenna 23 is connected in the second recess 25 to one strand of the cable 7, namely, to the coaxial strand. The internal conductor of the coaxial cable, also called the "core", is electrically connected, i.e., soldered, at the end of the second recess 25 to the contact area 24 of the antenna element 23. The external conductor of the coaxial cable is electrically connected, i.e., soldered, on the long sides of the second recess 25 to the contact areas 26 of the antenna 23. It is also possible for the connection to be established by adhesive bonding or by another suitable contacting technique. As can be seen in FIG. 7, no connection between the stranded wire of the cable 7 to a path or trace printed on the lower surface is provided in the first recess 22 of the circuit board 21.

Through use of the coaxial cable, the Bluetooth® signal in the 2.4 GHz band which has been received can be sent to the wireless data communications device, or the Bluetooth® signal to be sent can be supplied over it. The wave impedance of the coaxial cable is calculated in such a way that that optimal transmission and reception properties are ensured.

Instead of a printed circuit board antenna, it would also be possible to use some other type of antenna such as a linear antenna, a loop antenna, or a slot antenna.

Figure 8:
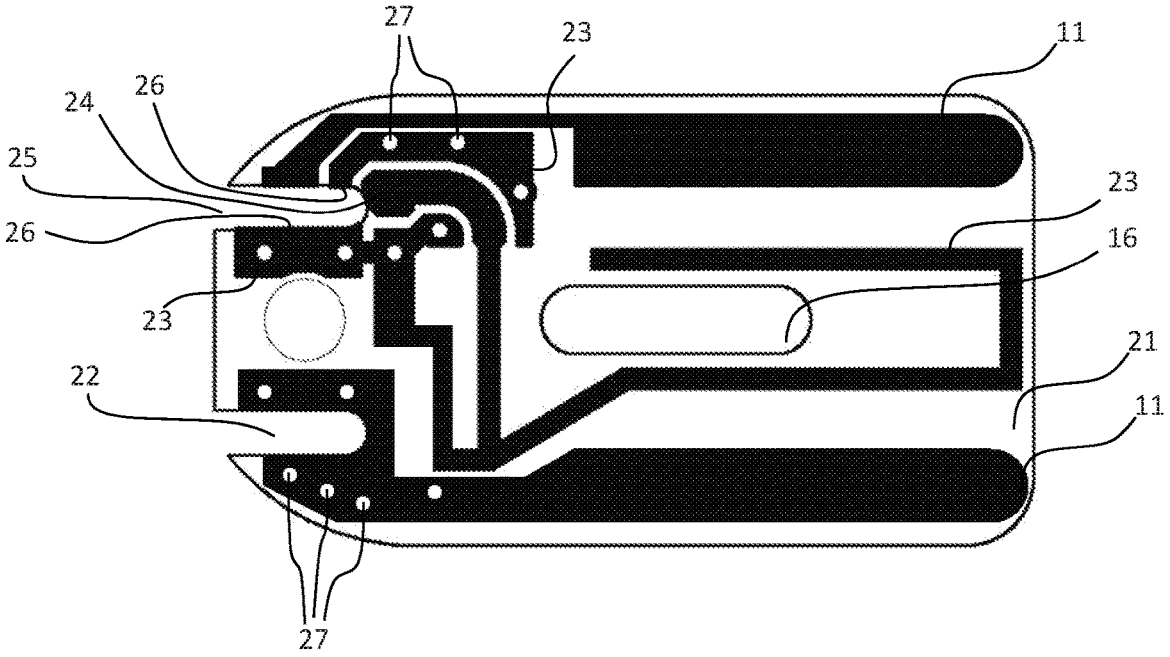
FIG. 8 shows a plan view of a surface of the printed circuit board of the plug element of another preferred embodiment of the massage device according to the invention.

FIG. 8 shows an alternative embodiment of PCB 21 in which charging electrodes 11 and antenna 23 are located on the same side of the circuit board. In addition to being arranged on the same side of PCB 21, charging electrodes and antenna 23 are substantially configured in the same manner as previously described. Reference can therefore be made to the description of FIGS. 6 and 7 above.

With the above-noted subject matter of the invention, a massage device is provided which offers reliable operation with an easy-to-charge energy storage unit, and which makes use of currently available wireless data transmission technologies.

The invention claimed is:

1. A massage device for massaging body parts comprising:

a massage portion including a housing having a device for producing vibration being an electric motor, an energy storage unit, a control unit and a wireless communications device;

a cable connected at one end to the massage portion; and a plug arranged at the other end of the cable and adapted to establishing a connection with a charging device;

wherein the plug is flat and configured for insertion into a Universal Serial Bus (USB) socket and wherein the plug comprises a printed circuit board having two USB-compatible charging electrodes and a printed circuit board (PCB) antenna for sending radio signals from and receiving radio signals in the wireless data communications device wherein the USB-compatible charging electrodes and the PCB antenna are both printed on the same printed circuit board, and the USB-compatible charging electrodes printed on the printed circuit board are freely exposed for directly contacting the respective electrodes of the Universal Serial Bus (USB) socket.

2. The massage device of claim 1 wherein the charging electrodes are arranged on one side of the printed circuit board, and the PCB antenna is arranged on the other side of the printed circuit board.

3. The massage device of claim 1 wherein the charging electrodes and the PCB antenna are arranged on a same side of the printed circuit board.

4. The massage device of claim 1 wherein the antenna is configured for the transmission and reception of radio signals for Near Field Communication (NFC), or Universal Mobile Telecommunications System (UMTS).

5. The massage device of claim 1 wherein the cable and the plug are configured to be liquid-tight.

6. The massage device of claim 1 wherein the cable comprises two strands.

7. The massage device of claim 6 wherein at least one cable strand is configured as a coaxial cable.

8. The massage device of claim 7 wherein the plug comprises two recesses each configured to accept each respective end of the two strands of the cable.

9. The massage device of claim 1 wherein the plug comprises a gripping area on a surface of the plug.

10. The massage device of claim 1 wherein at least a portion of the plug and/or of the cable is covered by a biocompatible plastic sheath.

11. The massage device of claim 10 wherein the biocompatible plastic sheath is formed by an injection-molding process.

12. The massage device of claim 1 wherein the charging electrodes of the plug comprise a coating with a metal or a metal alloy.

* * * * *